United States Patent [19]

Kimura et al.

[11] 3,945,190

[45] Mar. 23, 1976

[54] SWITCH MECHANISM FOR ELECTRONIC TIMEPIECE

[75] Inventors: Satoshi Kimura, Tokorozawa; Yoshifumi Mochizuki, Kodaira; Tetsuya Yasuda, Tokyo, all of Japan

[73] Assignee: Citizen Watch Co., Ltd., Tokyo, Japan

[22] Filed: June 24, 1974

[21] Appl. No.: 482,634

[30] Foreign Application Priority Data

| | | |
|---|---|---|
| June 28, 1973 | Japan | 48-72311 |
| Aug. 28, 1973 | Japan | 48-94040 |
| Aug. 27, 1973 | Japan | 48-100280 |
| Sept. 29, 1973 | Japan | 48-108917 |
| Oct. 6, 1973 | Japan | 48-116100 |
| Oct. 19, 1973 | Japan | 48-117646 |

[52] U.S. Cl. ..... 58/4 A; 58/50 R; 58/58; 58/85.5

[51] Int. Cl.[2] ..... G04B 19/24; G04B 19/30

[58] Field of Search ..... 58/4 A, 23 R, 50 R, 58, 58/85.5

[56] References Cited

UNITED STATES PATENTS

| | | | |
|---|---|---|---|
| 3,514,939 | 6/1970 | Cattin | 58/23 BA |
| 3,733,810 | 5/1973 | Girard | 58/50 R |
| 3,823,551 | 7/1974 | Riehl | 58/50 R |

*Primary Examiner*—Edith Simmons Jackmon

*Attorney, Agent, or Firm*—Ernest G. Montague; Karl F. Ross; Herbert Dubno

[57] ABSTRACT

A switch mechanism for an electronic timepiece which makes use of an electro-optical display element. The switch mechanism serves to effect erasure, correction and the like of the display and comprises an exteriorly operated member provided in its axial direction with a plurality of stable positions and rotatable about its axis at the stable positions and provided in its rotating sense with stable positions. An erasing switch is provided for erasing the display at the stable positions when the exteriorly operated member is rotated at one of the stable positions in its axial direction. A correction switch corrects the display at the stable position when said exteriorly operated member is rotated at at least one other stable position in its axial direction.

6 Claims, 12 Drawing Figures

SWITCH MECHANISM FOR ELECTRONIC TIMEPIECE

BACKGROUND OF THE INVENTION

1. Field of the invention

This invention relates to a switch mechanism for an electronic timepiece which makes use of an electro-optical display element such as a liquid crystal, photodiode and the like capable of displaying date, time, week days and the like. The switch mechanism serves to effect an erasure, correction and the like of the display.

2. Description of the prior art

This display element used for this kind of electronic timepiece can be made small so that it is particularly applicable to a wristwatch whose size is small. In addition, the display element must be operated with the aid of a battery for a long time and must easily be discernible. Particularly, a liquid crystal display element consumes less electric power when compared with the other kind of display and is only several tens of microns in thickness and provides the advantage that it can be made small in size and easily discernible even in the bright light. The liquid crystal, however, has the disadvantage that it becomes less discernible in the dark, and that its life is rather short because deterioration of the liquid crystal.

In order to easily discern the display in the dark, a timepiece comprising a liquid crystal display element has heretofore been proposed which makes use of a light source for illuminating the liquid crystal display element and incorporated in the timepiece and a switch mechanism which, when operated energizes the light source so as to illuminate the display surface.

A display element composed of a photodiode can be clearly seen in the dark, but has the disadvantage that the electric power consumed is large so that the battery for use with the wrist watch can not be used for continuous display over a long time.

In order to avoid this disadvantage an electronic timepiece makes use of the photodiode display element and in which for the sake of economy of the electric power the display is normally erased or cancelled and a switch mechanism is operated only when the user wishes to know time. The user then operates the display element and hence displays the time.

Such prior-art switch mechanism, however, has the disadvantage that provision must be made of an exteriorly operated member for each switch independently of another exteriorly operated member serving as a display correction switch, and as a result, the exteriorly operated members for all of the switches become large in number. There is also the risk that the exteriorly operated members may be erroneously operated and, in addition, that the electronic timepiece may be of poor design.

Moreover, the prior-art electronic timepiece which can display not only the hour and minutes but also seconds, date, weekday and the like creates the need for a number of places to be corrected which makes the correction of each display complex; as a result, there is the risk that other displays will be erroneously effected. In order to prevent such erroneous operation due to the increase in number of the display elements, it has been proposed to provide a mark for indicating the correction display element at the periphery of the time display element for the purpose of indicating the display element being corrected. The use of such mark for the purpose of confirming the place to be corrected results in an addition of displays not required for the time display. As a result, the display part, switch part, electrical circuit and the like become highly complex, thereby making the electronic timepiece expensive.

SUMMARY OF THE INVENTION

An object of the invention is to provide a switch mechanism for an electronic timepiece, which comprises not only a correction switch for all of the display parts necessary for the electonic timepiece and a display control switch for preventing consumption of the battery and deterioration of the liquid crystal but also a display change over switch, and which can control all of these switches by means of one exteriorly operated member only.

Another object of the invention is to provide a switch mechanism for an electronic timepiece, which comprises a display change-over switch which can operate when the display is corrected and in which the display part normally displaying days is changed over to the display relating to the date in case of correcting the day and weekday and is changed over to the display relating the seconds display to the correction in case of correcting the hour and minute.

The switch mechanism for an electronic timepiece according to the invention, is so constructed that the exteriorly operated member is provided in its rotating direction with at least one stable position so as to rotate the exteriorly operated member in a stepwise manner.

According to the invention the switch mechanism for an electronic timepiece is constructed such that if the exteriorly operated member is operated to make the switch ON or OFF, even when the exteriorly operated member is erroneously pushed down or pulled up, the exteriorly operated member is prevented from being moved in its axial direction toward another axial stable position.

The switch mechanism for an electronic timepiece according to the invention makes use of a setting lever spring and in which, when the exteriorly operated member is pushed down or pulled up to operate a switch the setting lever spring serves to effect switch, operations at more than two places in a simple and reliable manner.

The switch mechanism makes use of a thin or thick film resistive body vapor deposited or printed on one resistive timepiece substrate as a level shift resistive body capable of shifting the logic value form 0 to 1 and which can easily be manufactured.

DETAILED DESCRIPTION OF THE INVENTION

One embodiment of the invention will now be described with reference to the accompanying drawings.

Figure 1B:
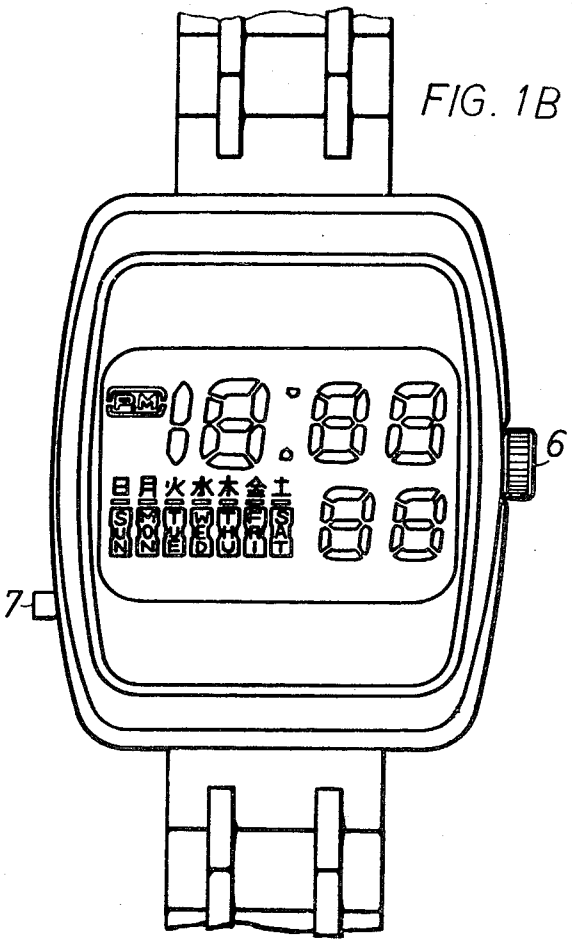
FIG. 1B shows similarly to FIG. 1A the electronic timepiece provided with the switch mechanism according to the invention and showing the display part in its erased condition after the exteriorly operated member has been rotated so as to operate the display erasing switch.
Figure 1A:
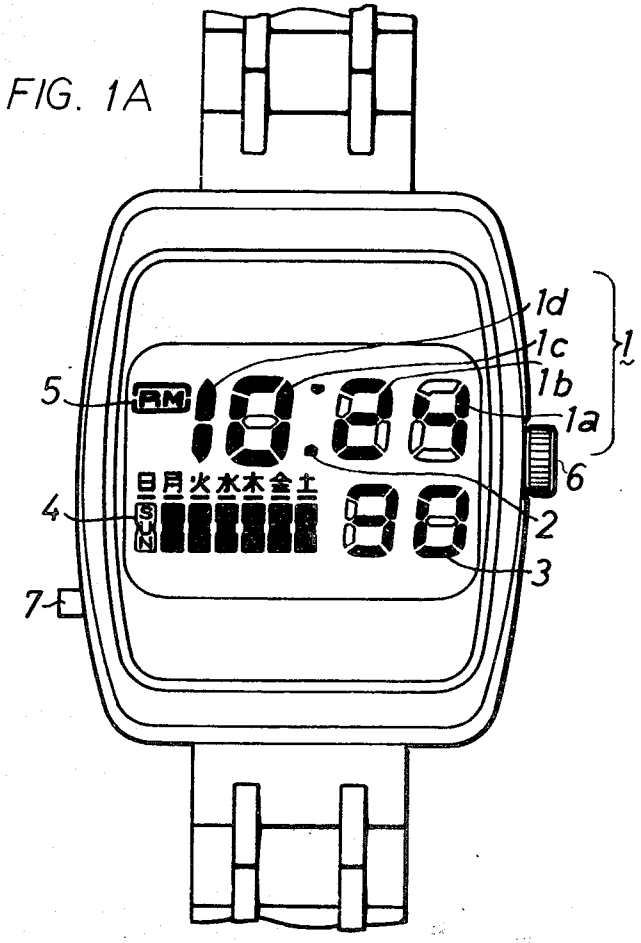
FIG. 1A is a plan view of an electronic timepiece provided with a switch mechanism according to the invention and showing the display part in its operated condition.

As shown in FIG. 1A, the electronic timepiece according to the invention makes use of a liquid crystal or photodiode and the like for effecting an electronic display at a time display part 1 composed of a display portion 1a for the unit digit of minutes, a display portion 1b for the tens digit of minutes, a display portion 1c for the unit digit of hours and a display protion 1d for the tens digit of hours, a colon display part 2 flashing at a period of 1 second, a date display part 3 for normally displaying the date and also for displaying the second by the operation hereinafter described, a day of-the-week display part 4 with day names printed in the same color as the color display to be effected by display elements and for displaying a given week day by concealing those week days which should not be displayed for the view, and an AM–PM display part 5.

In FIG. 1B are shown all of the display parts 1 to 5 shown in FIG. 1A which are erased by rotating a winding crown 6 and operating a display-erasing switch according to the invention as described later. In FIG. 1A, reference numeral 7 designates a zero second resetting button.

The switch mechanism according to the invention will now be described with reference to FIGS. 2 to 5. Reference numeral 8 designates a timepiece support, and 9 an exteriorly operated member composed of a threaded portion 9*a*, an annular groove 9*b* and a square sleeve portion 9*c*. The exteriorly operated member 9 is slidably and rotatably mounted on the timepiece support 8 and provided in its axial direction with at least one stable position. In the present embodiment, the exteriorly operated member 9 is a winding stem carrying with the winding crown 6 shown in FIGS. 1A and 1B. Reference numeral 10 designates a switch step cam plate provided with a roof shaped projection 10a and slidably mounted on the square sleeve part 9*c* of the exteriorly operated member 9 whose axial movement is limited by the timepiece support 8.

Reference numeral 11 designates a switch step leaf spring provided at its center with a square hole 11*a* and at its center with a depressed and partially broken portion 11*b* which is in turn provided at the both sides of the square hole 11*a*. The switch step leaf spring 11 is provided at each end with an elongate groove 11*c*. Screws 13 each extend through the respective elongate groove 11c and threadedly engage a sleeve 12 to cause the switch step leaf spring 11 to normally bear against the projection 10*a* of the switch step cam plate 10 with a given spring force. The switch step leaf spring 11 has a position at which the roof shaped end of the projection 10a engages with the square hole 11*a* to permit the exteriorly operated member 9 to be axially moved. If the exteriorly operated member 9 is rotated about its axis to bring the side edge of the projection 10*a* into engagement with a corner 8a of the timepiece support 8, the rotary angle of the exteriorly operated member 9 is limited. In addition, the front end of the projection 10*a* comes into engagement with either one of the depressed and partially broken portions 11*b*. This position is a stable position of the exteriorly operated member 9 in its rotating direction. Reference numeral 14 designates a holding plate for the switch step cam plate 10 and secured to the lower surface of the timepiece substrate 8 by means of screws 15. The holding plate 14 serves to hold the switch step cam plate 10 when assembling or disassembling the exteriorly operated member 9 until the exteriorly operated member 9 is inserted.

Reference nemeral 16 (FIG. 6) designates a switch wheel composed of a radially extending projection 16*a*, a right side projection 16*b*, a left side projection 16*c* and an annular groove 16d and slidably mounted on the square sleeve 9*c* of the exteriorly operated member 9.

Figure 2:
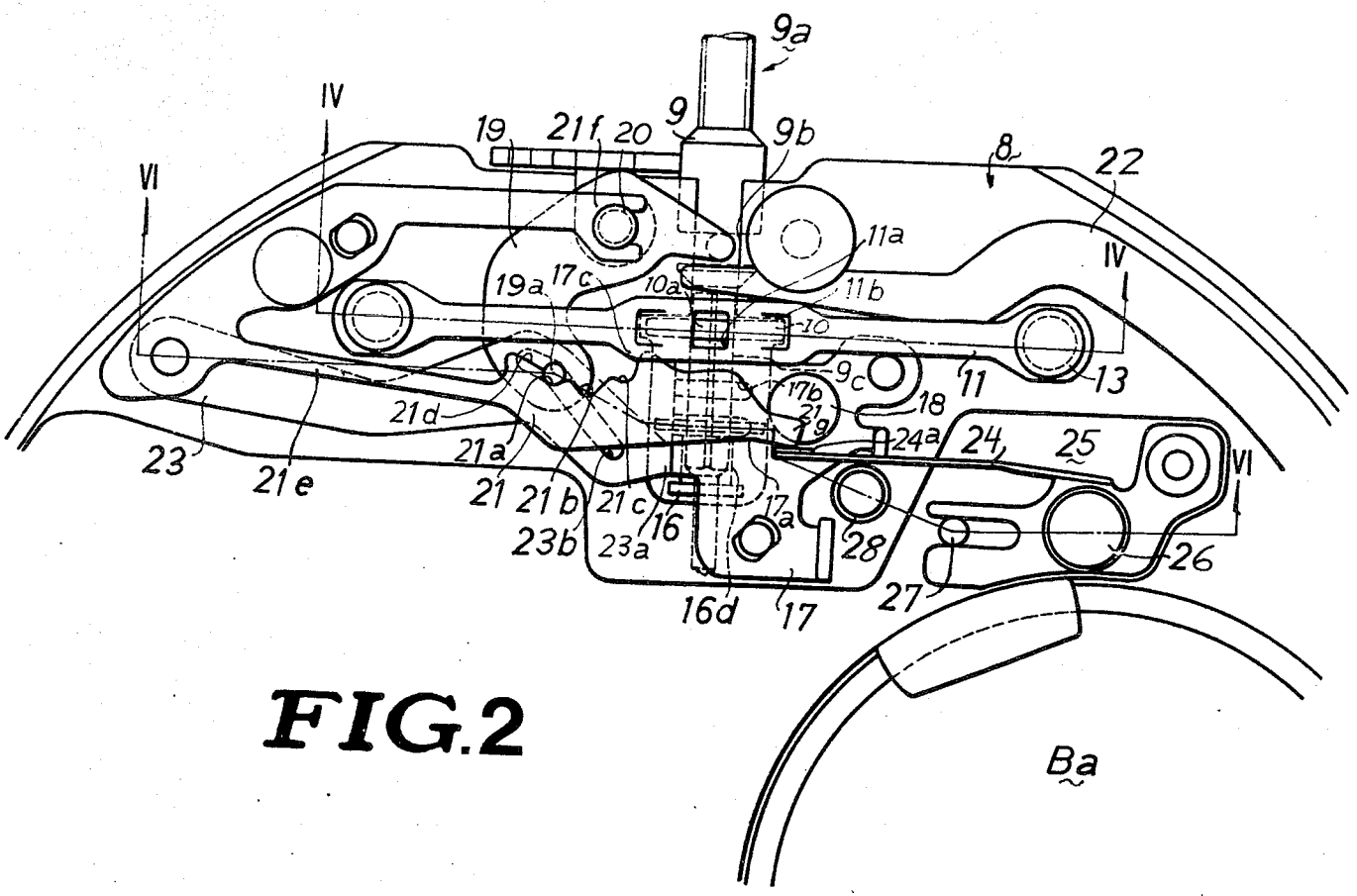
FIG. 2 is a plan view of one embodiment of the switch mechanism according to the invention.

Reference numeral 17 (FIG. 5) designates a plate for holding the switch wheel 16 and provided with notches 17*a*, 17*b* and 17*c* adapted to be engaged with the right side projection 16*b* and left side projection 16*c* of the switch wheel 16 when the switch wheel 16 is located at its three stable positions determined by the three stable positions of the exteriorly operated member 9 in its axial direction and by the exteriorly operated member 9 rotated. The holding plate 17 is secured to the timepiece substrate 8 by means of screws 18 (FIG. 2).

Reference numeral 19 designates a setting lever which is rotatably mounted on the timepiece substrate 8 by means of pivot 20 and is at its one end engaged with the annular groove 9*b* of the exteriorly operated member 9 and is provided at another end with a pin 19*a*. Reference numeral 21 designates a setting lever spring whose one end is secured to the timepiece substrate 8 and whose free end portion is provided with a plurality of, for example, three depressions 21*a*, 21*b* and 21*c* formed adjacent with each other. When the pin 19*a* of the setting lever 19 engages with the depression 21*a* as shown in FIG. 2, that is, when the pin 19*a* of the setting lever 19 is at its normal condition and the exteriorly operated member 9 is pulled out, the setting lever 19 is rotated about its pivot 20 in a counter clockwise direction. As a result, the pin 19*a* becomes engaged with the depression 21*b* or 21*c* to hold the exteriorly operated member 9 at one of three stable positions inclusive of its initial position in its axial direction.

In addition, it is possible to bring the pin 19a into engagement with an inclined edge 21*d* of the setting lever spring 21 or push down the exteriorly operated member 9 from its normal position so as to rotate setting lever 19 about its pivot 20 in a clockwise direction. If the force for pushing down the exteriorly operated member 9 is released, a return spring 22 provided for the timepiece substrate 8 and engaged with the exteriorly operated member 9 and a resilient member 21*e* of the setting lever spring 21 cause the exteriorly operated member 9 to return to its normal position.

The setting lever spring 21 is provided at its another end with a forked portion 21*f* which engages with the pivot 20 of the setting lever 19 so as to resiliently urge the setting lever 19 against the exteriorly operated member 9.

Reference numeral 23 designates a clutch lever whose one end is pivotally mounted on the timepiece substrate 8 and whose another end 23*a* engages with the annular groove 16*d* of the switch wheel 16. The clutch lever 23 is provided at its intermediate portion with an elongate groove 23*b* with which is engaged the setting lever pin 19*a*. The clutch lever 23 is swung around three positions corresponding to the three stable positions of the exteriorly operated member 9 in its axial direction and is capable of holding the switch wheel 16 by means of the end 23*a*.

Reference numeral 24 designates a display change over switch leaf spring disposed on an upper circuit substrate 25 and insulated from the timepiece substrate 8. The display change over switch leaf spring 24 is secured to the upper circuit substrate 25 by means of a screw 26 and electrically connected to a LSI to be described later by means of a pin 27. The display change over switch leaf spring 24 is normally urged against the switch wheel holding plate 17 when it is pulled up from its normal position by two steps and pushed down from its normal position by one step, against the pin 28. That is, the shape of the depression 21*c* and the inclined surface 21*d* with which is engaged the pin 19*a* causes the resilient part 21*e* of the setting lever spring 21 to bend, and as a result, the forward end 21*g* of the setting lever spring 21 comes into contact with the insulation portion 24*a* of the display change over switch leaf spring 24, thereby performing the above mentioned operation.

Figure 3:
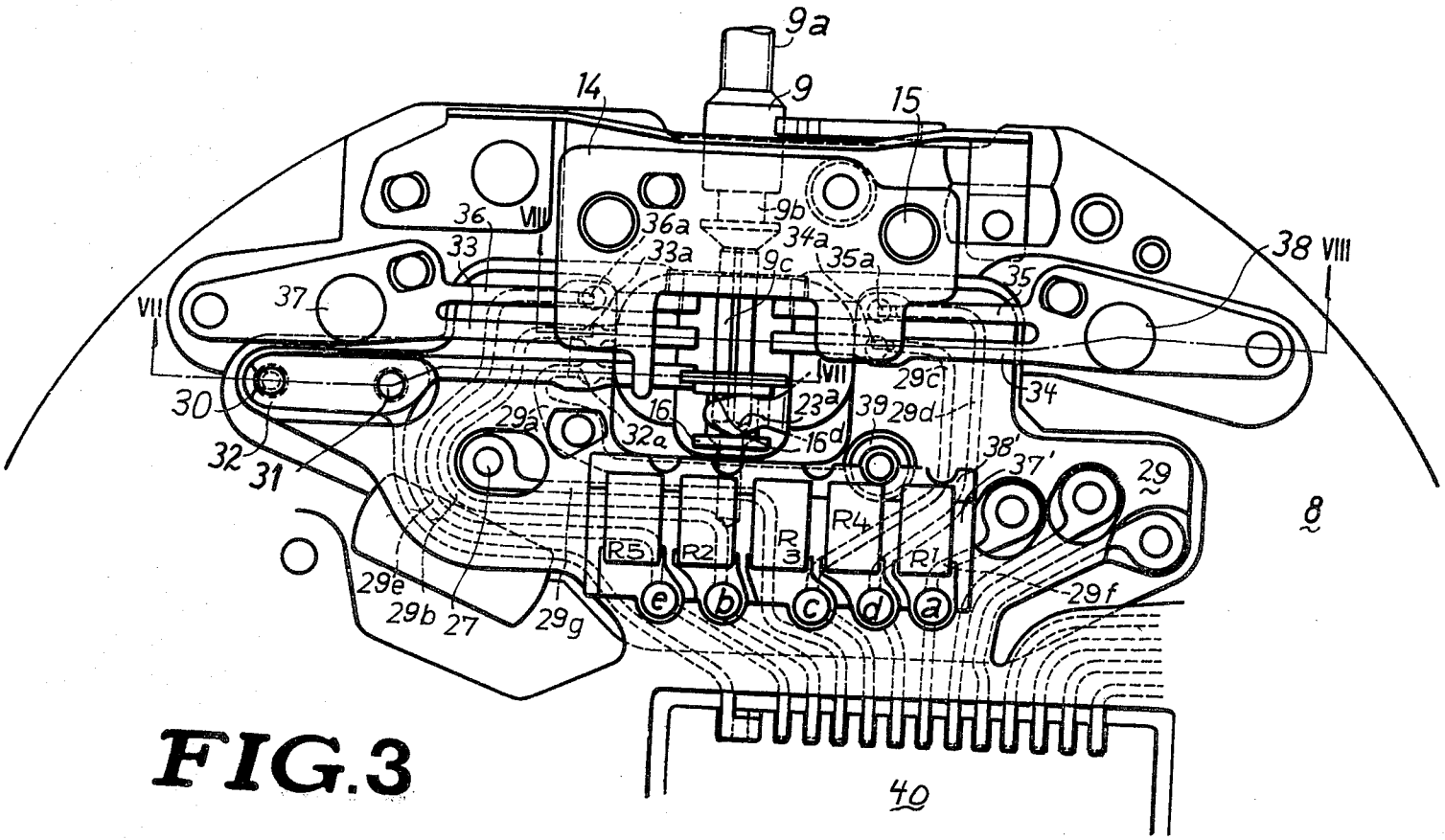
FIG. 3 is its back view.
Figure 4:
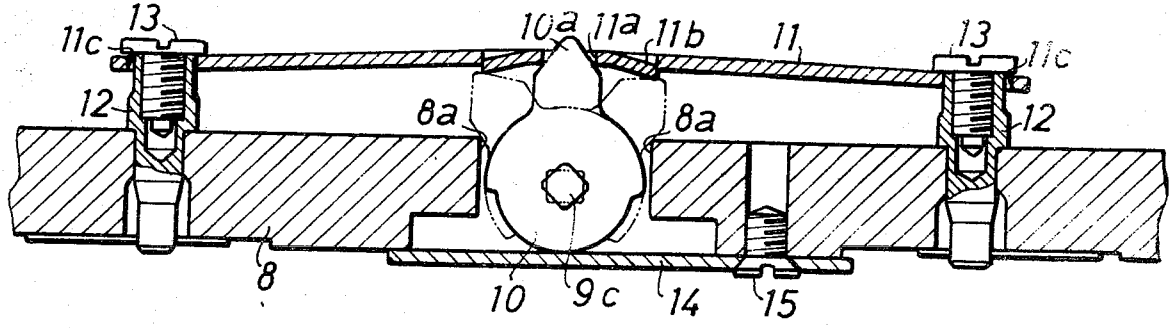
FIG. 4 is a section taken along line IV — IV of FIG. 2.
Figure 5:
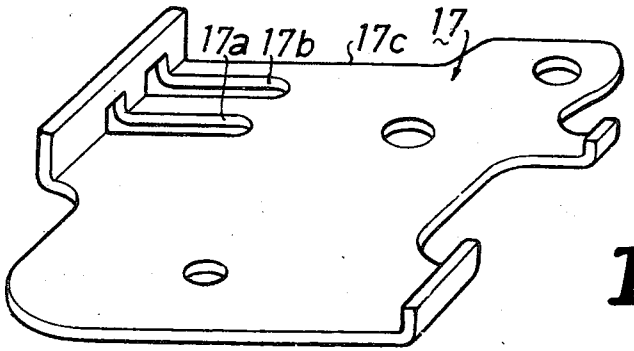
FIG. 5 is a perspective view showing the switch wheel holding plate used in the switch mechanism according to the invention.

In FIG. 3 are shown those parts which are located at the back side of the timepiece substrate 8 shown in FIG. 2. A lower circuit substrate 29 is secured to the timepiece substrate 8. This display erase switch leaf spring 32 is secured to the lower circuit substrate 29 by means of pins 30, 31 at a position which corresponds to the position of the projection 16*a* of the switch wheel 16 at the normal condition of the exteriorly operated member 9. A date correction leaf spring 33, day correction leaf spring 34, hour correction leaf spring 35 and minute correction leaf spring 36 are secured to the timepiece substrate 8 by means of screws 37 and 38 at positions which correspond to the projection 16*a* of the switch wheel 16 at the conditions taken when the exteriorly operated member 9 is pulled up by one step and two steps, respectively.

On the lower circuit substrate 29 are printed electroconductive paths 29*a* to 29*e* and the like for connecting contacts 32*a* to 36*a* of the switch leaf springs 32 to 36 to a terminal (−) or an electronic circuit to be described later.

Reference numeral 37′ designates a resistive substrate made of a thin material such as ceramic or material having a similar nature and secured to the lower circuit substrate 29 adjoining the switch leaf spring 32 to 35, 36 by a suitable means such as cementing and the like, 38 an electroconductive body deposited on the resistive substrate 37′ by a process such as vapor deposition or printing and the like, 39 a (−) terminal grounded and connected to the electroconductive body 38, $R_1$ to $R_5$ a thin or thick film resistor deposited on the resistive substrate 37′ by a process such as vapor deposition or printing and always connected to the electroconductive body 38, a to e connection terminals for the resistive bodies $R_1$ to $R_5$, and 40 a LSI composed of a correction circuit, a time counting circuit and a decoder. The electroconductive path 29*a* is connected to the (−) terminal 38 and the other electroconductive paths 29*b* to 29*e* are connected through the connection terminals *b*,*c*,*d*,*e*, to the correction circuit of the LSI 40. The connection terminal a is connected to the electroconductive path 29*f* leading to the zero second resetting button 7 shown in FIGS. 1A and 1B.

Reference numeral 27 designates a pin insulated through an insulating member from the timepiece substrate 8 and extending through the timepiece substrate 8. The pin 27 is electroconductively connected to the display turn over switch leaf spring 24 on the one hand and connected through the electroconductive path 29*g* to the LSI 40 on the other hand.

The operation of the switch mechanism according to the above described embodiment will now be described.

Figure 6:
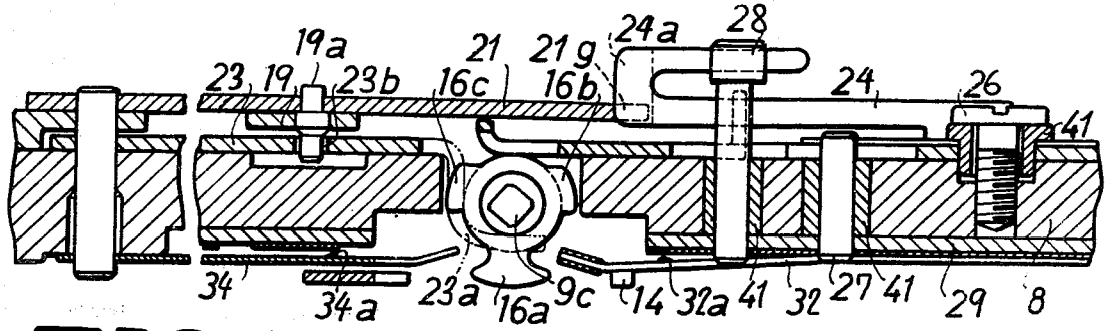
FIG. 6 is a section taken along line VI — VI of FIG. 2.
Figure 7:
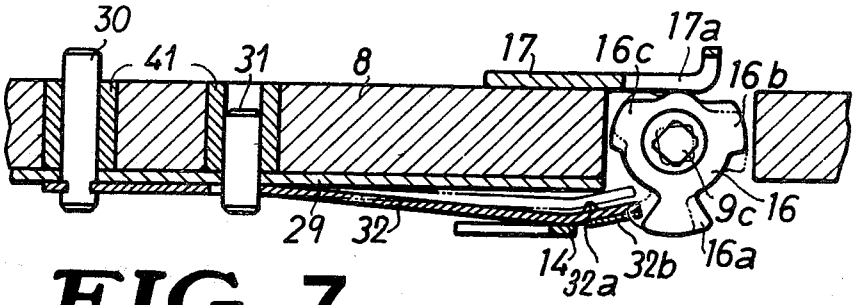
FIG. 7 is a section taken along line VII — VII of FIG. 3.

In FIG. 6, the display change over switch leaf spring 24 is changed over from the contact with the switch wheel holding plate 17 to the contact with the pin 28 by means of the front end 21*g* of the setting lever spring 21 under the conditions that the exteriorly operated member 9 is pulled up by two steps and pushed down by step, respectively. That is, the switch wheel holding plate 17 is electroconductively connected to the timepiece substrate 8 and also to the (+) electrode of the battery Ba (FIG. 2). The pin 28 electroconductively connected to the (−) electrode of the battery Ba is secured through the insulating sleeve 41 to the time support 8 so that the logic condition of the input of the LSI 40 through the display change over leaf switch spring 24 and the pin 28 becomes changed, thereby changing over the given display. In the present embodiment, the day display is changed over to the second display. As shown in FIG. 7, a display erasing switch leaf spring 32 is secured at its one end to the lower circuit substrate 29 by means of pins 30, 31 each insulated through the insulating sleeve 40 from the timepiece support 8. As a result, the display erasing switch leaf spring 32 is electroconductively connected at its one end to an electroconductive path leading from the correction circuit on the lower circuit substrate and urged by its own spring action at its other end against the switch step holding plate 14 under normal position shown by a full line. The switch step holding plate 14 is secured to the timepiece substrate 8 electroconductively connected to one of the electrodes of the battery Ba. As a result, the display erasing switch leaf spring 32 electroconductively connects the lower circuit substrate 29 through an electroconductive path to the battery Ba. Under such condition, the display mechanism is operated to display. The exteriorly operated member 9 in its normal position upon rotation of the winding crown 6 (FIGS. 1A and 1B), interrupts the contact between the display erasing switch leaf spring 32 and the switch step holding plate 14 by the projection 16*a*. The display erasing switch leaf spring 32 is provided at its front end with an insulating member 32*b* which is engaged with the projection 16*a* to interrupt the electroconductive connection with the timepiece substrate 8 and comes into contact with the electroconductive path 29*a* connected to the (−) side on the lower circuit substrate 29, and as a result, the display mechanism stops its operation to erase the display.

Figure 8:
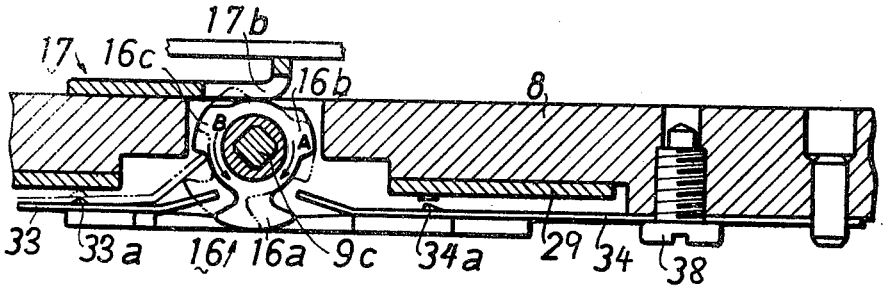
FIG. 8 is a section taken along line VIII — VIII of FIG. 3.

As shown in FIGS. 3 and 8, the day correction switch leaf spring 33 and the week day correction switch leaf spring 34 are secured to the timepiece support 8 by means of screws 37, 38, respectively. If the exteriorly operated member 9 pulled by one step is rotated in a clockwise direction as shown by an arrow A, the projection 16*a* of the switch wheel 16 is urged against the day correction switch leaf spring 33 which is then brought into contact with the electroconductive path 29*b* on the lower circuit substrate 29. If the exteriorly operated member 9 pulled up by one step is rotated in a counter clockwise direction as shown by an arrow B, the projection 16*a* of the switch wheel 16 is urged against the week day correction switch leaf spring 34 which is then brought into contact with the electroconductive path 29*c* on the lower circuit substrate 29.

As seen from the above, the electroconductive connection through the electroconductive path on the lower circuit substrate 29 to the correction circuit ensures the day correction or the week day correction. Similarly, the hour correction leaf spring 35 and the minute correction leaf spring 36 are capable of effecting the hour and minute corrections, respectively.

As seen from FIGS. 7 and 8, if the display erase or display correction switching is effected, the right side projection 16*b* or the left side projection 16*c* of the switch wheel 16 comes into contact with the side notch 17*a* or 17*b* of the switch wheel holding plate 17 so that the exteriorly operated member 9 could not be pushed down or pulled up under its rotated condition.

The display correction device of the switch mechanism according to the invention is capable of receiving the signal delivered when the switch member becomes ON and OFF by the operation of the exteriorly operated member 9, delivering an output signal relaing to the display corresponding to the switch member to the timepiece circuit, and operating the decoder and the display circuit, thereby correcting the display concerned. The correction circuit for effecting the above described operation becomes unstable when the switch member is OFF and there is a risk of the correction circuit being erroneously operated when the switch member becomes ON. As a result, when the switch member is OFF the correction circuit must be held in its stable state.

Figure 9:
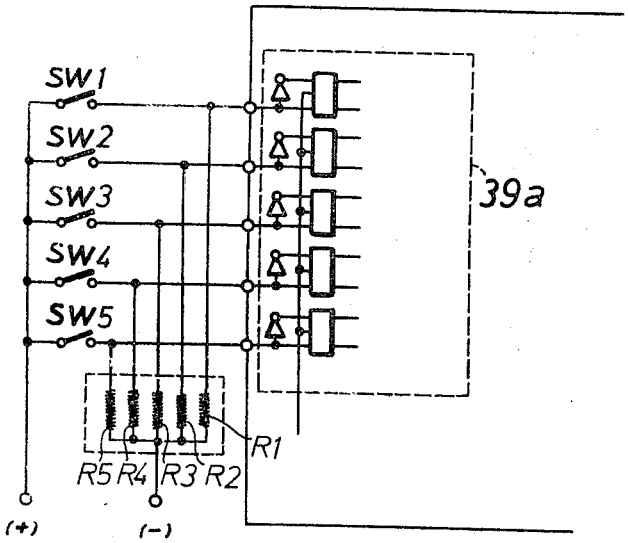
FIG. 9 (PRIOR ART)
FIG. 9 is circuit diagram showing a prior-art device for holding a display correction circuit in its stable state.

In FIG. 9 is shown a device for holding the correction circuit in its stable state when the switch member is OFF. The device comprises switch members $SW_1$ to $SW_5$ which are connected through level shift resistors $R_1$ to $R_5$ to the (−) side, that is, to ground. The resistors $R_1$ to $R_5$ are adapted to make the logic value of the part of the correction circuit 40*a* coresponding to each of the switch members $SW_1$ to $SW_5$ 0 or 1 irrespective of ON or OFF condition of the switch members $SW_1$ to $SW_5$.

The device shown in FIG. 9, however, takes up much space and hence provides a limitation to the other members or other electronic circuit of an electronic wrist watch, thereby making the electronic wristwatch thick in depth and large in size.

Figure 10A:
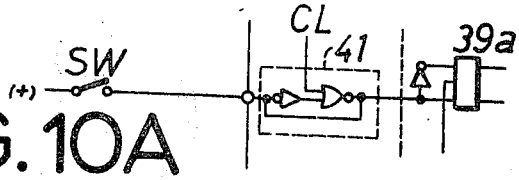
FIGS. 10A and 10B are circuit diagrams showing modified devices for holding the display correction circuit shown in FIG. 9 in stable state.

In FIG. 10A is shown a modified device for holding the correction circuit in its stable state when the switch member is OFF. In the present device, between each circuit element of a correction circuit 40*a* and each switch member SW is inserted a special circuit 42 for holding the correction circuit 40*a* in its stable state even when the switch member SW becomes OFF. The circuit arrangement of this device, however, is expensive owing to the presence of the special circuit 42.

Figure 10B:
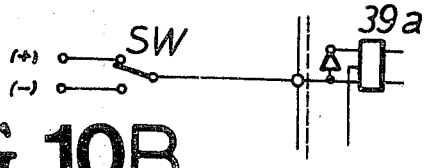

In FIG. 10B is shown another modified device in which the switch member SW is a change over switch capable of always connecting the circuit element of the correction circuit 40*a* to (+) side or to (−) side so as to hold the circuit 40 in its stable state. The circuit arrangement of the present device has also the disadvantage that the switch member SW is large in size and complex in construction so that the timepiece becomes large in size and thickness and hence becomes expensive.

In the present invention, on the same substrate is disposed a resistive body for level shift required for a plurality of switch members, the resistive body bing arranged adjoining the switch member. That is, the thin film resistive bodies $R_1$ to $R_5$ are arranged on the resistive substrate 37 by vapor deposition, printing or like process and are connected each other by the electroconductive body 38 as shown in FIG. 3 which is similar in the circuit arrangement to the prior art device shown in FIG. 9. The resistive substrate 37 is arranged adjoining the display erase switch leaf spring 32, date correction leaf spring 33, week day correction leaf spring 34, hour correction leaf spring 35, and minute correction leaf spring 36 so that the circuit arrangement as a whole is compact. In addition, the exteriorly operated member 9 is rotatable in a direction opposite to its rotating direction for operating the display erase switch leaf spring 32 in its normal position. This rotation of the exteriorly operated member 9 may be used to ignite a light source through a switch and hence clearly discern the display of the liquid crystal in the dark.

As stated hereinbefore, the switch mechanism for the electronic timepiece according to the invention has the following advantages.

1. Provision is made of a correction switch for each display part required for an electronic timepiece, an erase switch for a display for preventing consumption of a battery or deterioration of a liquid crystal, and a display change over switch and all of these switches are controlled by one exteriorly operated member. This construction renders it unnecessary to provide a plurality of exteriorly operated members, has no limitation as to design, and is compatible in operation with the prior art mechanical type timepiece.

2. The display change over switch is operated in response to the operation of the exteriorly operated member so that the display part normally indicating the date causes the date display to be changed over to the display related to the date display in case of day and week day correction and causes the second display to be changed over to the display related to the second display in case of hour and minute correction, and as a result, the stable position taken by the exteriorly operated member when it is moved in its axial direction is clearly indicated, thereby preventing any other display from being erroneously corrected by the user.

3. The exteriorly operated member is provided in its rotating direction with stable positions which cause the exteriorly operated member to rotate step by step and ensures a reliable switch operation. In addition, it is possible to prevent the switch mechanism from becoming broken due to the overrun of the exteriorly operated member. If the display is automatically corrected by pulse signals whose inervals are constant, the exteriorly operated member is not required to be held by the user's hand when the switch is closed.

4. The step mechanism composed of the switch step cam plate 10 and the switch step leaf spring 11 is independent of the axial movement of the exteriorly operated member 9 and operates in the same manner at any stable position of the exteriorly operated member 9 taken by it when it is moved in its axial direction, thereby constituting a step mechanism free from play.

5. If the exteriorly operated member is operated to make the switch ON or OFF, such erroneous operation of the exteriorly operated member as to move it to another axial stable position is prevented so that the switch mechanism or the timepiece or any other constitutional element is not accidentally broken. This ensures a protection of the switch mechanism and mechanisms related thereto in a safe manner.

6. In case of operating switches by pushing down or pulling up in exteriorly operated member, the use of the setting lever spring 21 provides the advantage that more than two switches can be operated in a simple and reliable manner, and that the setting lever spring becomes firmly engaged with the setting lever 19, thereby easily stepping the winding stem.

7. The level shift resistive body is of a thin or thick film resistive body vapor deposited or printed on the resistive substrate so that the level shift resistive body can be made spaceless and can easily be manufactured in a less expensive manner.

8. As seen from the above mentioned embodiment, the same display part is capable of effecting the change over the display from day to second and vice versa and also effecting a plurality of displays so that the display part can be simplified.

What is claimed is:

1. A switch mechanism for an electronic timepiece comprising an electric optical display, an exteriorly operated member having a square pillar portion and provided in its axial direction with a plurality of stable positions and rotatable about its axis at at least one of said stables positions of axial direction and provided in its rotating direction with stable positions of rotational direction, an earasing switch for erasing the display at the stable positions of rotational direction of said exteriorly operated member, a correction switch for correcting the display at a stable position of axial direction, and a change over switch for changing over the display when said exteriorly operated member is moved from one of said stable positions of axial direction to another stable position of axial direction and vice versa.

2. A switch mechanism for an electronic timepiece as claimed in claim 1 and further comprising a holding mechanism including a switch step cam plate secured to the square pillar portion of said exteriorly operated member and co-rotatably connected to said exteriorly operated member and made stationary when said exteriorly operated member is moved in its axial direction and a resilient member secured to a timepiece substrate and engaged with said switch step cam plate and permitting a stepwise rotation of said switch step cam plate, whereby said exteriorly operated member is held at one of its stable positions of rotational direction.

3. A switch mechanism for an electronic timepiece as claimed in claim 1 and further comprising a switch wheel mounted on the square pillar portion of said exteriorly operated member and rotatable in response to the rotation of said exteriorly operated member, a clutch lever engaged with said switch wheel and for determining that position of said switch wheel which corresponds to each of the stable positions of said exteriorly operated member of axial direction, switch contacts arranged selectively in correspondence with the positions of said switch wheel, and a switch wheel holding plate provided with notches, whereby when said exteriorly operated member is rotated at the stable position of axial direction, said switch wheel causes each of said switches to effect ON and OFF by rotation and is held at the stable position of rotational direction of said exteriorly operated member and becomes engaged with said notch of said switch wheel holding plate so as to limit the movement of said exteriorly operated member in its axial direction.

4. A switch mechanism for an electronic timepiece as claimed in claim 1 and further comprising a setting lever spring having portions which are engaged with a pin provided for a setting lever operatively connected to said exteriorly operated member, whereby at at least two positions of said exteriorly operated member in its axial direction said depressed or inclined portions cause the resilient portion of said setting lever spring to be bent so as to effect said switch operation.

5. A switch mechanism for an electronic timepiece as claimed in claim 1 and further comprising a plurality of switch members controlled by said exteriorly operated member, and a plurality of level shift resistors mounted on a resistive substrate mounted on said timepiece substrate adjoining said plurality of switch members.

6. A switch mechanism for an electronic timepiece as claimed in claim 1 and further comprising a display change over switch capable of changing over a date display to a second display displayed by display elements of two figures which are identical with those of the date display.

* * * * *